US005991586A

United States Patent [19]

Nagao

[11] Patent Number: 5,991,586

[45] Date of Patent: Nov. 23, 1999

[54] DEVELOPING DEVICE INCLUDING A MAGNETIC REGULATING MEMBER

[75] Inventor: Taisuke Nagao, Itami, Japan

[73] Assignee: Minolta Co., Ltd., Osaka, Japan

[21] Appl. No.: 08/955,614

[22] Filed: Oct. 22, 1997

[30] Foreign Application Priority Data

Oct. 25, 1996 [JP] Japan ..... 8-301280

[51] Int. Cl.[6] ..... G03G 15/09

[52] U.S. Cl. ..... 399/274; 399/275; 399/277

[58] Field of Search ..... 399/267, 270, 399/274–277

[56] References Cited

U.S. PATENT DOCUMENTS

| | | | |
|---|---|---|---|
| 4,825,241 | 4/1989 | Saijo et al. | 399/275 |
| 4,851,872 | 7/1989 | Murasaki et al. | 399/275 |
| 4,960,070 | 10/1990 | Nishimura et al. | 399/270 |
| 5,396,026 | 3/1995 | Sato et al. | 399/276 |
| 5,424,489 | 6/1995 | Sato et al. | 399/276 |

FOREIGN PATENT DOCUMENTS

| | | |
|---|---|---|
| 6-266233 | 9/1994 | Japan . |
| 8-240989 | 9/1995 | Japan . |

*Primary Examiner*—William J. Royer

*Attorney, Agent, or Firm*—Burns, Doane, Swecker & Mathis, LLP

[57] ABSTRACT

A developing device which regulates the amount of developer transported on a developing sleeve via a regulating member constructed as a magnetic member, so as to not have large fluctuation in the amount of developer transported by a developing sleeve to a developing region even when there is dislocation in the install position of the regulating member, and which produces excellent images having stable density without image noise.

15 Claims, 9 Drawing Sheets

DEVELOPING DEVICE INCLUDING A MAGNETIC REGULATING MEMBER

BACKGROUND OF THE INVENTION

1. Field of the Invention

The present invention relates to a developing device used to develop an electrostatic latent image formed on an image-carrying member in an image forming apparatus such as a copier, printer and the like. The present invention specifically relates to a developing device provided with a magnet member having a plurality of magnetic poles on the interior side of a developing sleeve that rotates to transport developer to a developing region confronting said image-carrying member, and which controls the amount of developer transported to said developing region via said developing sleeve by means of a regulating member disposed so as to confront said developing sleeve through a predetermined gap.

2. Description of the Related Art

Conventionally, in image forming apparatuses such as copiers, printers and the like, various developing devices have been used to develop latent images formed on an image-carrying member.

FIG. 1 shows an example of such a developing device. A magnet member 12 having a plurality of magnetic poles N and S is provided within a developing sleeve 11 disposed so as to confront an image-carrying member 1. Developer is maintained on the surface of developing sleeve 11 via the magnetic force of the magnet member 12. Developer is transported in a magnetic brush state to the image-carrying member 1 by means of the rotation of the developing sleeve 11. Developer transported to a developing region opposite the image-carrying member is regulated by a regulating member 13 provided so as to confront the developing sleeve 11 with a predetermined spacing therebetween. Developing sleeve 11 transports a suitable quantity of developer in a magnetic brush state to the developing region, and brings the developer into contact with the image-carrying member. An electrostatic latent image formed on the surface of the image-carrying member is developed, thereby.

When accomplishing developing through contact of a magnetic brush with the image-carrying member 1, however, the toner supplied to the image-carrying member is swept by the magnetic brush, thereby producing streak-like noise in the formed image which disturbs the image.

In recent years, there have been investigations into developing by narrowing the gap Db between the developing sleeve 11 and the regulating member to reduce the amount of developer transported to the developing region by the developing sleeve 11, and using the action of an alternating electric field in the developing region wherein the developing sleeve 11 confronts the image-carrying member 1 so as to accomplish developing without contact between the developer and the image-carrying member.

When the gap Db between the developing sleeve 11 and regulating member 13 is narrowed, however, irregular amounts of developer are transported to the developing region by the developing sleeve 11. Furthermore, foreign matter contained within the developing device as well as flocculant such as flocculated developer and the like within the developing device may accumulate between the developing sleeve 11 and the regulating member 13 so as to prevent developer from being transported by the developing sleeve 11 and produce undeveloped image areas such as white streaks and the like in the formed images.

A regulating member 13 formed of magnetic material magnetically binds the developer to the regulating member 13. Therefore, a suitable amount of developer is transported by developing sleeve 11 to the image-carrying member 1 even when the gap Db is increased between the developing sleeve 11 and regulating member 13.

Even when the regulating member 13 is formed as a magnet member, however, there is variation in the positional relationship between the regulating member 13 and the magnetic pole S of the magnet member 12 confronting the regulating member 13 due to the positioning of the magnet member 12 in the interior side of the developing sleeve 11. Furthermore, when there is variation in the gap Db between the developing sleeve 11 and the regulating member 13, there is great fluctuation in the amount of developer transported by the developing sleeve 11 to image-carrying member 1. Suitable developing cannot be accomplished when too much or too little developer is transported to the image-carrying member 1, such that images having stable density and without image noise cannot be obtained.

SUMMARY OF THE INVENTION

An object of the present invention is to produce excellent images having stable density and without noise even when a regulating member formed as a magnet member is used to regulate the amount of developer transported by a developing sleeve and there occurs variation in the positional relationship of the regulating member and the magnetic pole of a magnet member disposed in confrontation to the regulating member due to dislocation in the position of the regulating member, dislocation of the placement position of a magnet member within the developing sleeve and the like.

The developing device of the present invention achieves the aforesaid objects by providing a developing device comprising a magnet member having a plurality of magnetic poles on the interior side of a developing sleeve which transports developer to a developing region confronting an image-carrying member, and a regulating member formed as a magnet member to regulate the amount of developer transported to a developing region by the developing sleeve, the regulating member being disposed so as to confront the developing sleeve through a predetermined gap, wherein the regulating member is disposed at an area such that the fluctuation range of the vertical magnetic force at the pole of the regulating member is less than 10 Gauss.

When the regulating member is disposed at an area such that the fluctuation range of the vertical magnetic force in the magnet member at an area confronting the regulating member is less than 10 Gauss as in the developing device of the present invention, there is only slight fluctuation of the vertical magnetic force of the magnetic pole at a position confronting the regulating member even when there is dislocation of the position of the installed regulating member, or position of the magnet member on the interior side of the developing sleeve within the area of the fluctuation range of less than 10 Gauss.

Therefore, even when there is dislocation of the position of the regulating member and the like, there is only slight variation in the amount of developer regulated by the regulating member and transported to the developing region, and developing is accomplished using a stable amount of developer transported to the developing region so as to produce excellent images having stable density and without image noise.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE RELATED ART

The preferred embodiments of the developing device of the present invention are described hereinafter with reference to the accompanying drawings.

Figure 1:
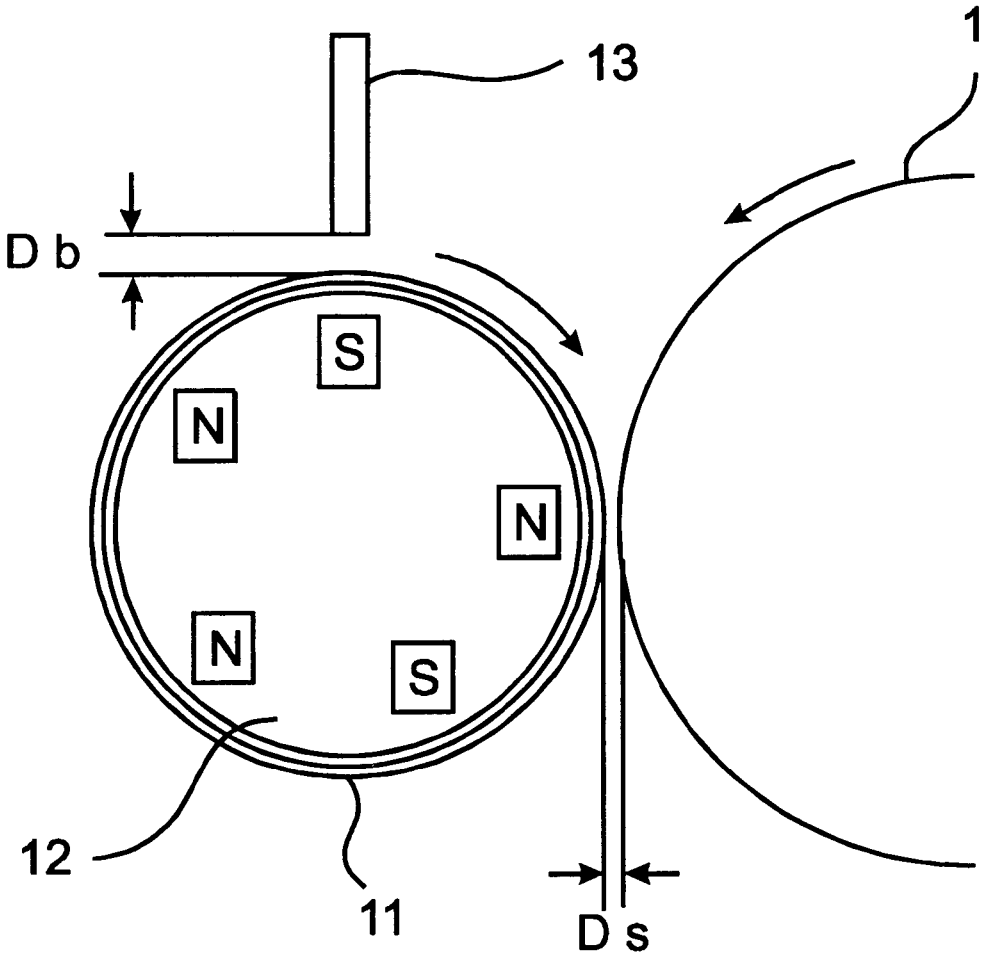
Fig. 1 (Prior Art)
FIG. 1 briefly illustrates a developing device using a regulating member to regulate the amount of developer transported via a developing sleeve to a developing region confronting an image-carrying member.
Figure 2:
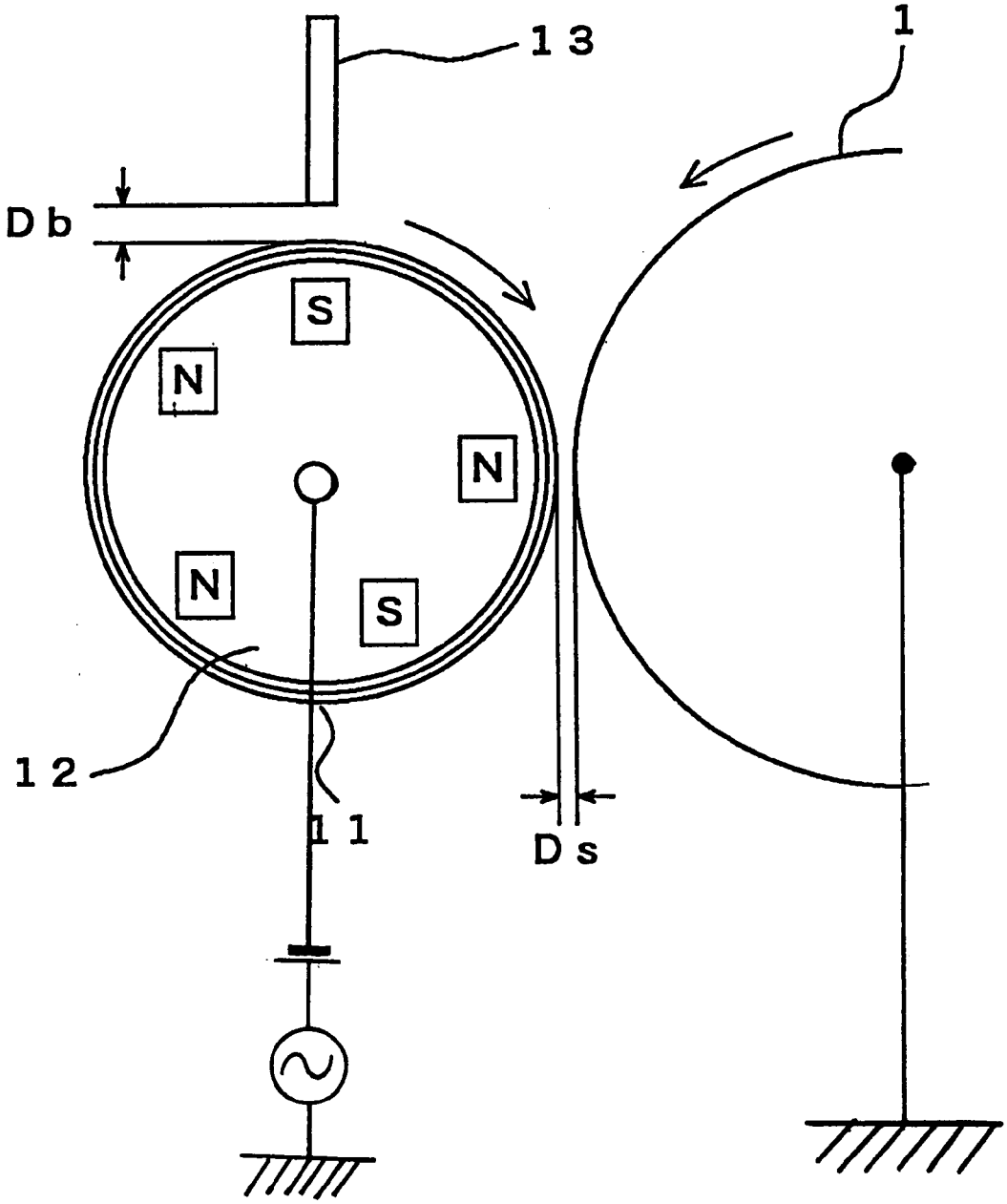
FIG. 2 briefly illustrates the developing device of the present invention.
Figure 3:
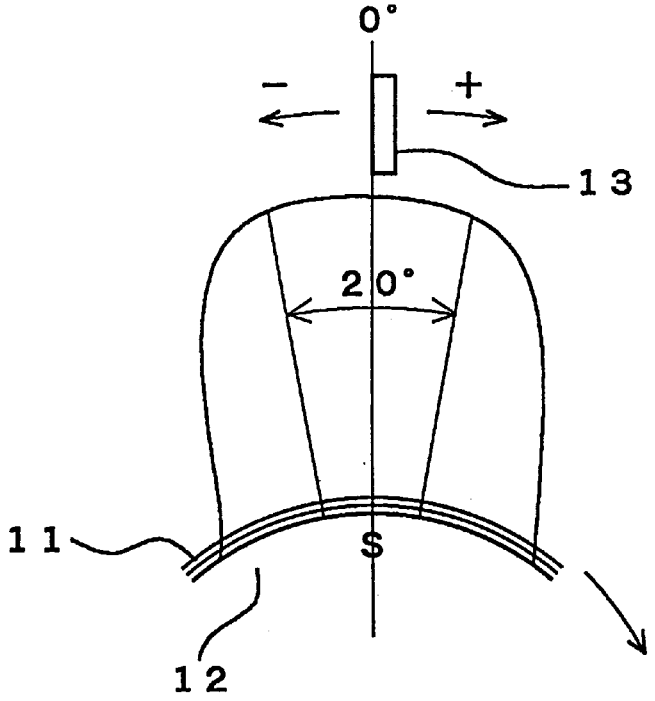
FIG. 3 shows the vertical magnetic force distribution of the magnetic pole of a magnet member at a position opposite the regulating member in a first example of the developing device.

The developing device of the present invention shown in FIG. 2 and the developing device of FIG. 1 are similarly provided with a magnet member 12 having a plurality of magnetic poles N, S on the interior side of a developing sleeve 11 disposed so as to confront an image-carrying member 1. Developer is maintained on the surface of developing sleeve 11 by means of the magnetic force of the magnet member 12. Developer is transported in a magnetic brush state to the image-carrying member 1 via the rotation of the developing sleeve 11. The transported developer is regulated by a regulating member 13 provided so as to confront the developing sleeve 11 through a predetermined gap Db. The regulating member 13 is formed of stainless steel or the like as a magnetic member.

After the amount of developer being transported to the developing region opposite the image-carrying member is regulated by the regulating member, the developer is delivered to the developing region by developing sleeve 11. A developing bias voltage comprising an alternating current overlaid on a direct current is applied to developing sleeve 11 so as to generate an alternating current electric field in the developing region wherein developing sleeve 11 confronts image-carrying member 1, such that the developer develops an electrostatic latent image without contact with the image-carrying member 1.

In the developing device of the present embodiment, when the fluctuation range of vertical magnetic force at magnetic pole S of magnet member 12 confronting regulating member 13 is set in an area of less than 10 Gauss, there is minimal fluctuation of the vertical magnetic force of magnetic pole S of magnet member 12 confronting regulating member 13 even when the gap Db is changed between regulating member 13 and developing sleeve 11 due to change in the positional relationship between regulating member 13 and the magnetic pole S of magnet member 12 confronting the regulating member 13 causing slight dislocation of the install position of the regulating member 13, or the position of the magnet member 12 on the interior side of developing sleeve 11 within the area of less than 10 Gauss. Therefore, the amount of developer regulated by the regulating member 13 and delivered to the developing region does not change markedly, and a constant amount of developer is stably transported to the developing region for use in developing. As a result, excellent images having stable density are produced without image noise.

The advantages of the developing device of the present invention are described hereinafter based on specific examples.

EXAMPLE 1

In the developing device of an example 1 of the present invention, a magnetic pole S of magnet member 12 positioned at an area confronting regulating member 13 has an area of vertical magnetic force distribution which exhibits a relatively unchanging and flat vertical magnetic force. The fluctuation range of vertical magnetic force in this flat area of vertical magnetic force distribution is 8 Gauss in an angular range of 20° in the circumferential direction from the upstream side to the downstream side in the developer transport direction with magnetic pole S as a center.

Figure 4:
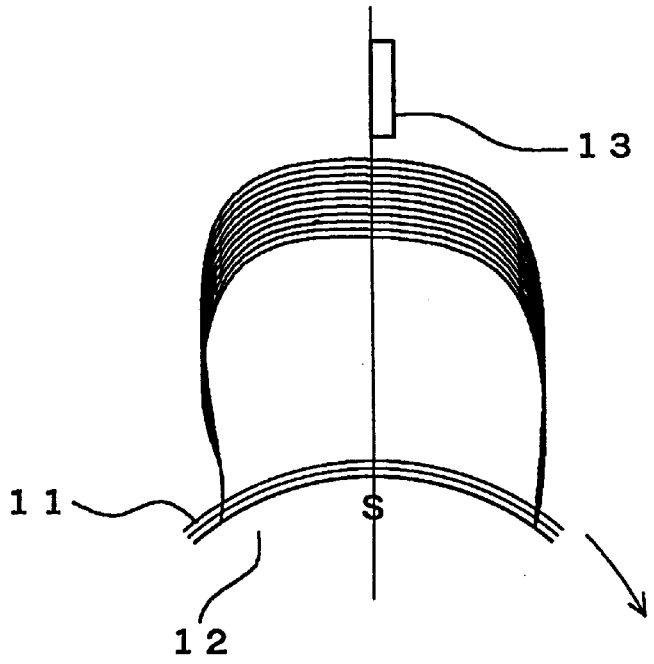
FIG. 4 shows the condition of the vertical magnetic force distribution of the aforesaid magnetic pole in the developing device of the first example measured when changing the distance from the developing sleeve in 0.1 mm increments.

The distance from regulating member 13 to developing sleeve 11 was varied in 0.1 mm increments from 0 to 1 mm, and the vertical magnetic force distribution was measured at magnetic pole S of magnet member 12 confronting regulating member 13. Measurement results are shown in FIG. 4.

These measurements show that the vertical magnetic force distribution of magnetic pole S becomes dense as the gap distance is changed in 0.1 mm increments, resulting in a small fluctuation range of vertical magnetic force due to the change in distance from developing sleeve 11.

In the developing device of the present embodiment, the developer was a two-component developer comprising a magnetic carrier having a mean particle size of 30 $\mu$m, and a toner having a mean particle size of 8 $\mu$m, with a toner density of 13 percent-by-weight. The regulating member 13 was constructed as a magnetic member formed of ferrite stainless steel SUS430. The developing sleeve 11 was rotated at a speed of 165 mm/sec.

In the developing device of the present embodiment, the install position of the regulating member 13 was varied, such that the angle was changed between the edge of the regulating member 13 on the upstream side in the developer transport direction and the magnetic pole S of magnet member 12 relative to the center of the magnet member 12. Furthermore, the gap Db was changed between regulating member 13 and developing sleeve 11. Then, the amount of developer transported past regulating member 13 was determined.

The angle formed between the edge of regulating member 13 on the upstream side in the developer transport direction and the magnetic pole S of magnet member 12 was designated 0° relative to the center of magnet member 12 to match the position of magnetic pole S, and this angle was varied within a range of −15° to +15°; the side wherein the edge of regulating member 13 on the upstream side in the developer transport direction was positioned upstream from the magnetic pole S in the developer transport direction was designated negative, and the downstream side in the developer transport direction was designated positive.

Figure 5:
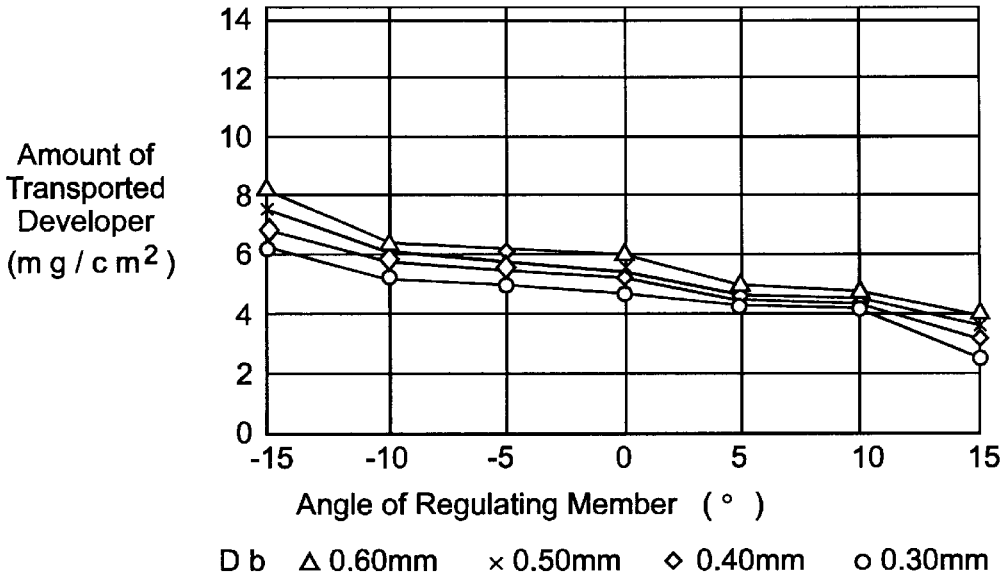
FIG. 5 shows the change in the install angle of the regulating member, and the change in the amount of developer transported past the regulating member in the developing device of the first example.

The change in the amount of developer transported past regulating member 13 was determined when the gap Db between regulating member 13 and developing sleeve 11 was set at 0.60 mm, 0.50 mm, 0.40 mm, and 0.30 mm, and the angle was varied between the edge of regulating member 13 on the upstream side in the developer transport direction and the magnetic pole S of magnet member 12 relative to the center of the magnet member 12. The measurement results are shown in FIG. 5. In FIG. 5, a gap Db of 0.60 mm is represented by the Δ symbol, a gap Db of 0.50 mm is represented by the × symbol, a gap Db of 0.40 mm is represented by the ◇ symbol, and a gap Db of 0.30 mm is represented by the ○ symbol.

Measurement results show there was minimal change in the amount of transported developer when the position of regulating member 13 was changed at the area wherein the vertical magnetic force was less than 10 Gauss with the angle formed between the edge of the regulating member 13 on the upstream side in the developer transport direction and the magnetic pole S of magnet member 12 relative to the center of the magnet member 12. There was also minimal change in the amount of transported developer in conjunction with the change in the gap Db.

In contrast, when regulating member 13 was set at positions of −15° and +15° outside the range of −10° to +10°, the amount of transported developer varied greatly, and there was also a large variation in the amount of transported developer in conjunction with the change in the gap Db.

Figure 6:
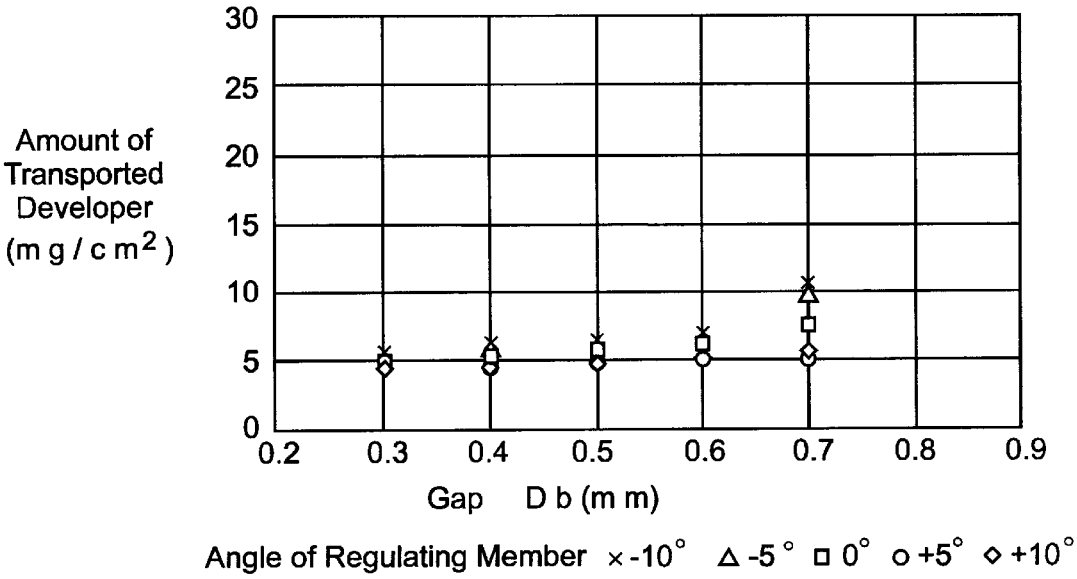
FIG. 6 shows the change in the gap between the developing sleeve and regulating member, and the change in the amount of developer transported past the regulating member in the developing device of the first example.

The change in the amount of developer transported past regulating member 13 was determined when the gap Db between regulating member 13 and developing sleeve 11 was varied within a range of 0.30 mm to 0.70 mm, and the position of regulating member 13 was varied within a range of −10° to +10° of the angle formed between the edge of regulating member 13 on the upstream side in the developer transport direction and the magnetic pole S of magnet member 12 relative to the center of the magnet member 12. The measurement results are shown in FIG. 6. In FIG. 6, an angle of −10° is represented by the × symbol, an angle of −5° is represented by the Δ symbol, an angle of 0° is represented by the □ symbol, an angle of +5° is represented by the ○ symbol, and an angle of +10° is represented by the ◇ symbol.

Measurement results show there was minimal change in the amount of transported developer when the position of regulating member 13 was changed with the angle formed between the edge of the regulating member 13 on the upstream side in the developer transport direction and the magnetic pole S of magnet member 12 relative to the center of the magnet member 12 within a range of −10° to +10° with the gap Db between regulating member 13 and developing sleeve 11 set at 0.30 mm to 0.60 mm. There was marked fluctuation in the amount of transported developer, however, when the angle formed between the regulating member 13 and magnetic pole S was varied and the gap Db between the regulating member 13 and developing sleeve 11 was set at 0.70 mm and greater. It is therefore desirable that the gap Db between the regulating member 13 and developing sleeve 11 is set at 0.60 mm or less.

Figure 7:
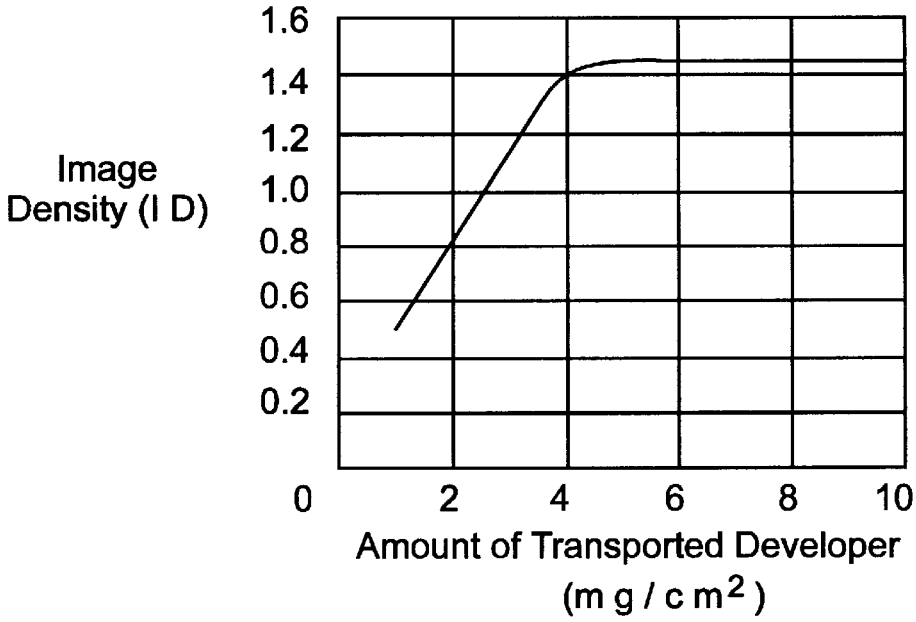
FIG. 7 shows the correlation between the amount of developer transported to the developing region and the image density of the formed image in the developing device of the first example.
Figure 8:
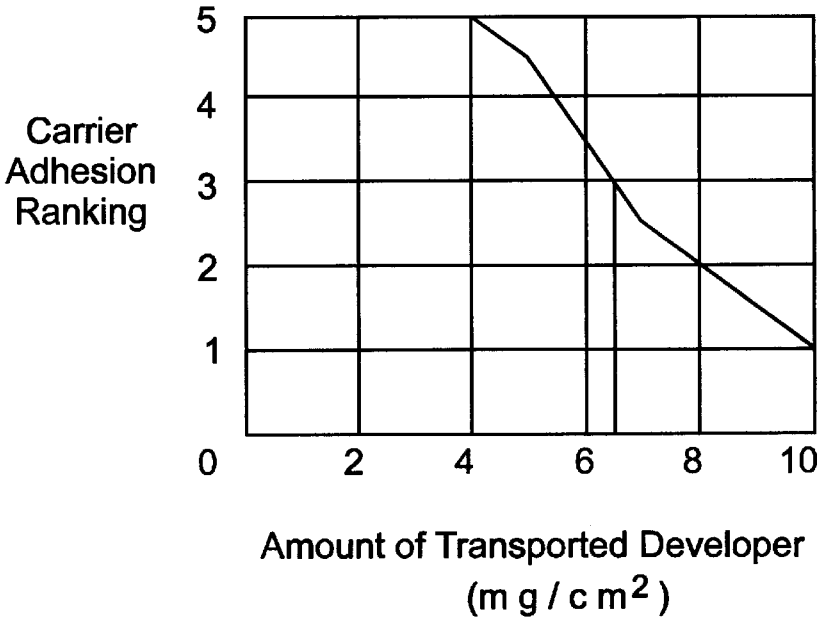
FIG. 8 shows the correlation between the amount of developer transported to the developing region and carrier adhesion on the image-carrying member in the developing device of the first example.

Next, the gap Ds between the developing sleeve 11 and the image-carrying member 1 was set at 0.35 mm in the aforesaid developing device. The surface potential of image-carrying member 1 was set at −450 V, and developing was accomplished by applying to developing sleeve 11 a developing bias voltage comprising an alternating current voltage having a square wave frequency of 3 kHz with a peak-to-peak voltage Vp-p of 1.6 kV overlaid on a direct current voltage of −350 V. The relationship between the amount of transported developer delivered to the developing region by developing sleeve 11 and the image density of the image formed by developing was investigated. Measurement results are shown in FIG. 7. Furthermore, the relationship between the amount of transported developer and carrier adhesion on image-carrying member 1 was also investigated. Measurement results are shown in FIG. 8. The carrier adhesion shown in FIG. 8 was evaluated visually in five rankings. A complete absence of carrier adhesion was ranked 5, slight carrier adhesion was ranked 4, carrier adhesion at a lower limit which posed no practical problem at a lower limit was ranked 3, carrier adhesion preventing practical use was ranked 2, and severe carrier adhesion was ranked 1.

As can be understood from the measurement results, it is desirable that the amount of transported developer is 4 mg/cm$^2$ or greater to achieve an adequate image density of 1.4 or higher in the formed image. From the perspective of suppressing carrier adhesion on the image-carrying member 1, it is desirable that the amount of transported developer is less than 6.5 mg/cm$^2$.

In the aforesaid developing device, the amount of developer transported past regulating member 13 was investigated when the vertical magnetic force of the magnetic pole S of magnet member 12 at an area confronting regulating member 13 was varied within a range of 200 to 450 Gauss to accomplish developer transport regulation by regulating member 13. The measurement results are shown in Table 1 below. Developer transportability was evaluated visually by monitoring the state of the developer transported on developing sleeve 11. Uniform developer amount transported on developing sleeve 11 is represented by the ○ symbol, irregular amount of transported developer is represented by the Δ symbol, and almost no transported developer is represented by the × symbol.

TABLE 1

| Magnetic Force (Gauss) | 200 | 250 | 300 | 350 | 400 | 450 |
|---|---|---|---|---|---|---|
| Transportability | x | Δ | ○ | ○ | ○ | ○ |

The measurement results show developer was not transported via developing sleeve 11 to the developing region opposite image-carrying member 1 when the magnetic force of magnetic pole S of magnet member 12 at an area confronting regulating member 13 was less than 200 Gauss. Irregular amounts of developer were transported by developing sleeve 11 to the developing region when the magnetic force was less than 300 Gauss. In order to transport a stable amount of developer without amount irregularity to the developing region opposite image-carrying member 1, it is desirable that the magnetic force of magnetic pole S of magnet member 12 is set at 300 Gauss or higher.

EXAMPLE 2

Figure 9:
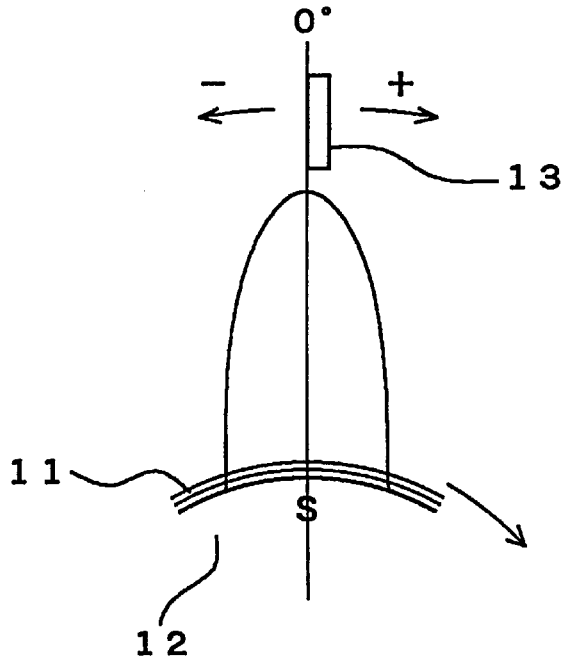
FIG. 9 shows the vertical magnetic force distribution of the magnetic pole of a magnet member at a position confronting the regulating member in a developing device of a second example.

In the developing device of the present example, only the magnetic pole S of magnet member 12 was changed in the area confronting regulating member 13 in the developing device of example 1. As shown in FIG. 9, the vertical magnetic force distribution of magnetic pole S has a small fluctuation range without a flat area, and resembles conventional parabolic lines of force. Magnetic pole S had a vertical magnetic force fluctuation range of about 320 Gauss with the regulating member 13 adjusted within a range of −10° to +10° from the upstream side in the developer transport direction relative to the center of magnetic pole S.

Figure 10:
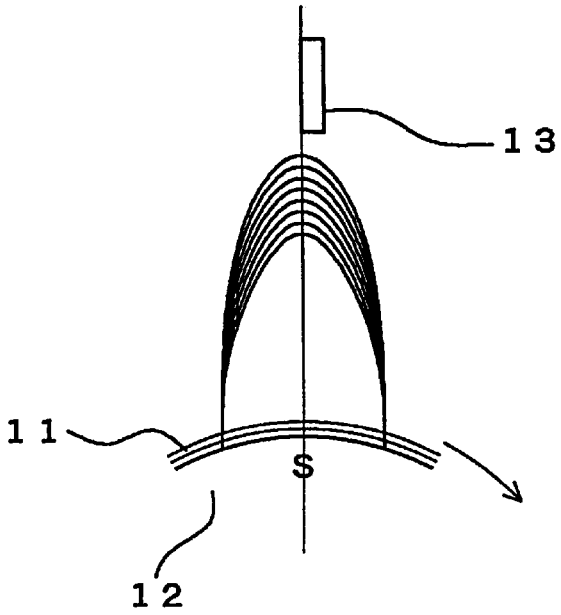
FIG. 10 shows the condition of the vertical magnetic force distribution of the magnetic pole in the developing device of the second example measured when changing the distance from the developing sleeve in 0.1 mm increments.

The vertical magnetic force of magnetic pole S was measured while varying the distance from the developing sleeve 11 within a range of 0 to 1 mm in 0.1 mm increments, as in example 1. The measurement results are shown in FIG. 10.

The measurement results show the vertical magnetic force distribution of magnetic pole S measured when changing the distance in 0.1 mm increments formed a sparse condition compared to the aforesaid example 1. The fluctuation range of vertical magnetic force increases as a result of the change in the distance from developing sleeve 11.

The change in the amount of developer transported past regulating member 13 was determined when the gap Db between regulating member 13 and developing sleeve 11 was varied, the angle was varied between the edge of regulating member 13 on the upstream side in the developer transport direction and the magnetic pole S of magnet member 12 relative to the center of the magnet member 12, and the install position of regulating member 13 was varied in the same manner as previously described in example 1.

Figure 11:
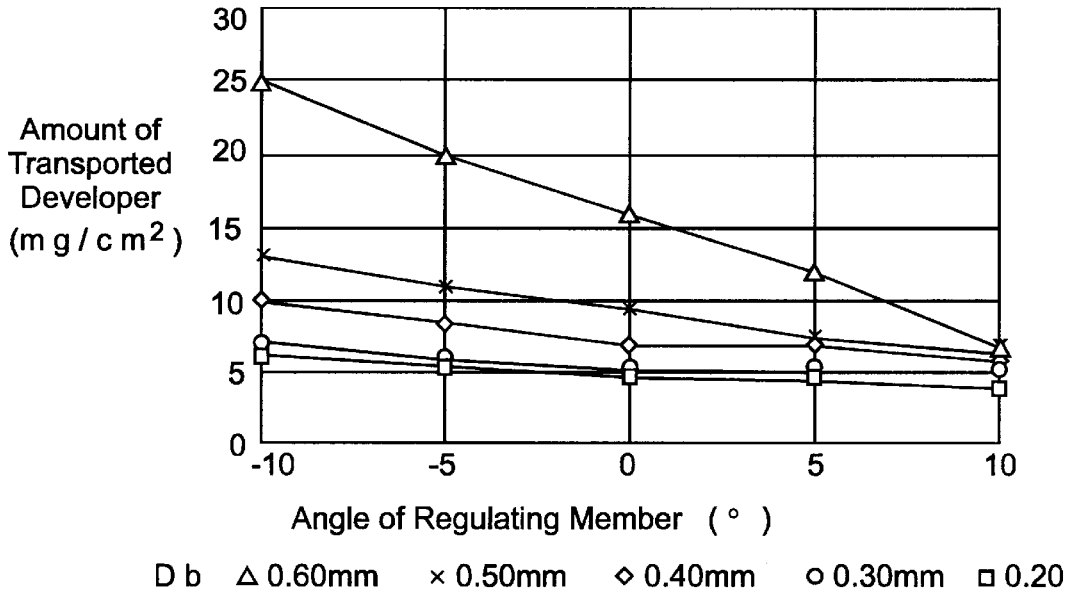
FIG. 11 shows the change in the install angle of the regulating member, and the change in the amount of developer transported past the regulating member in the developing device of the second example.

In this example, the gap Db between regulating member 13 and developing sleeve 11 was set at 0.60 mm, 0.50 mm, 0.40 mm, 0.30 mm, and 0.20 mm, and the angle formed between the edge of regulating member 13 on the upstream side in the developer transport direction and the magnetic pole S of magnet member 12 was varied within a range of −10° to +10°. The change in the amount of developer transported past regulating member 13 was determined. Measurement results are shown in FIG. 11. In FIG. 11, a gap Db of 0.60 mm is represented by the Δ symbol, a gap Db of 0.50 mm is represented by the × symbol, a gap Db of 0.40 mm is represented by the ◇ symbol, a gap Db of 0.30 mm is represented by the ○ symbol, and a gap Db of 0.20 mm is represented by a □ symbol.

The measurement results in this example show that the amount of transported developer changed markedly when the install position of regulating member 13 changed, and when the gap Db was changed between the position of the regulating member 13 and the developing sleeve 11, due to the increased fluctuation range of vertical magnetic force of magnetic pole S.

Figure 12:
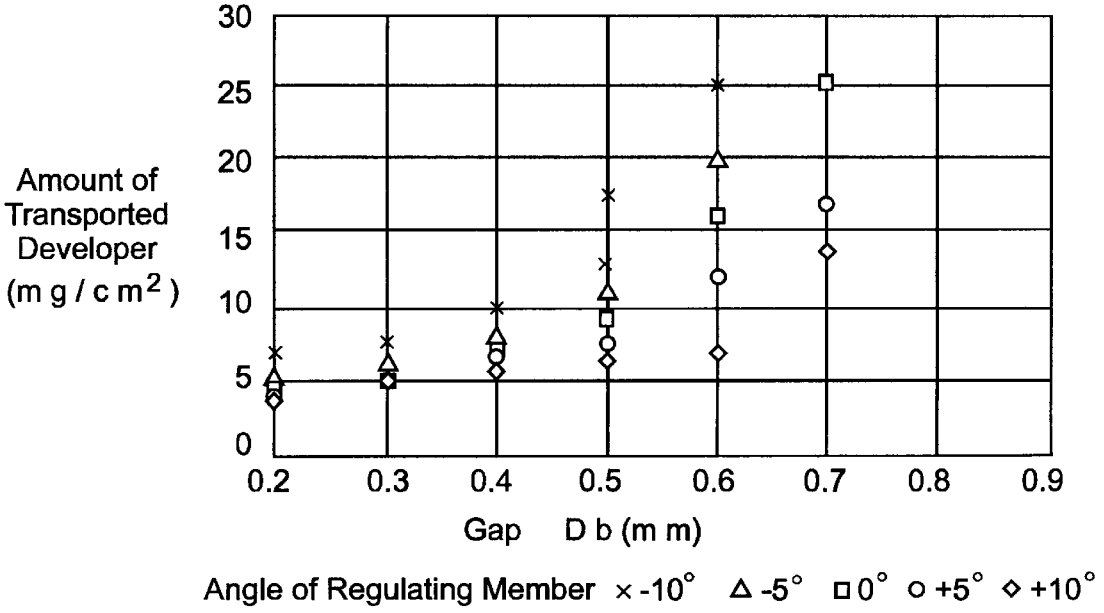
FIG. 12 shows the change in the gap between the developing sleeve and regulating member, and the change in the amount of developer transported past the regulating member in the developing device of the second example.

The gap Db between regulating member 13 and developing sleeve 11 was varied within a range of 0.20 to 0.70 mm, and the angle formed between the edge of regulating member 13 on the upstream side in the developer transport direction and the magnetic pole S of magnet member 12 was varied within a range of −10° to +10°. Then, the change in the amount of developer transported past regulating member 13 was determined. The measurement results are shown in FIG. 12. In FIG. 12, an angle of −10° is represented by the × symbol, an angle of −5° is represented by the Δ symbol, an angle of 0° is represented by the □ symbol, an angle of +5° is represented by the ○ symbol, and an angle of +10° is represented by the ◇ symbol.

The measurement results show that the amount of transported developer changed only slightly when the gap Db between regulating member 13 and developing sleeve 11 was less than 0.30 mm even when the angle formed between the edge of regulating member 13 on the upstream side in the developer transport direction and the magnetic pole S of magnet member 12 was varied within a range of −10° to +10°. When the gap Db between regulating member 13 and developing sleeve 11 exceeded 0.30 mm, however, the amount of transported developer changed markedly with even slight dislocation of the angle formed between regulating member 13 and magnetic pole S.

Therefore, in the developing device of the present example, there was large variation in the amount of developer transported past regulating member 13 with even slight dislocation of the angle formed between regulating member 13 relative to magnetic pole S of magnet member 12, and slight change in the gap Db between regulating member 13 and developing sleeve 11. That is, a predetermined amount of developer could not be stably transported if the install position of regulating member 13 or the set position of magnet member 12 were not accurate.

EXAMPLE 3

Figure 13:
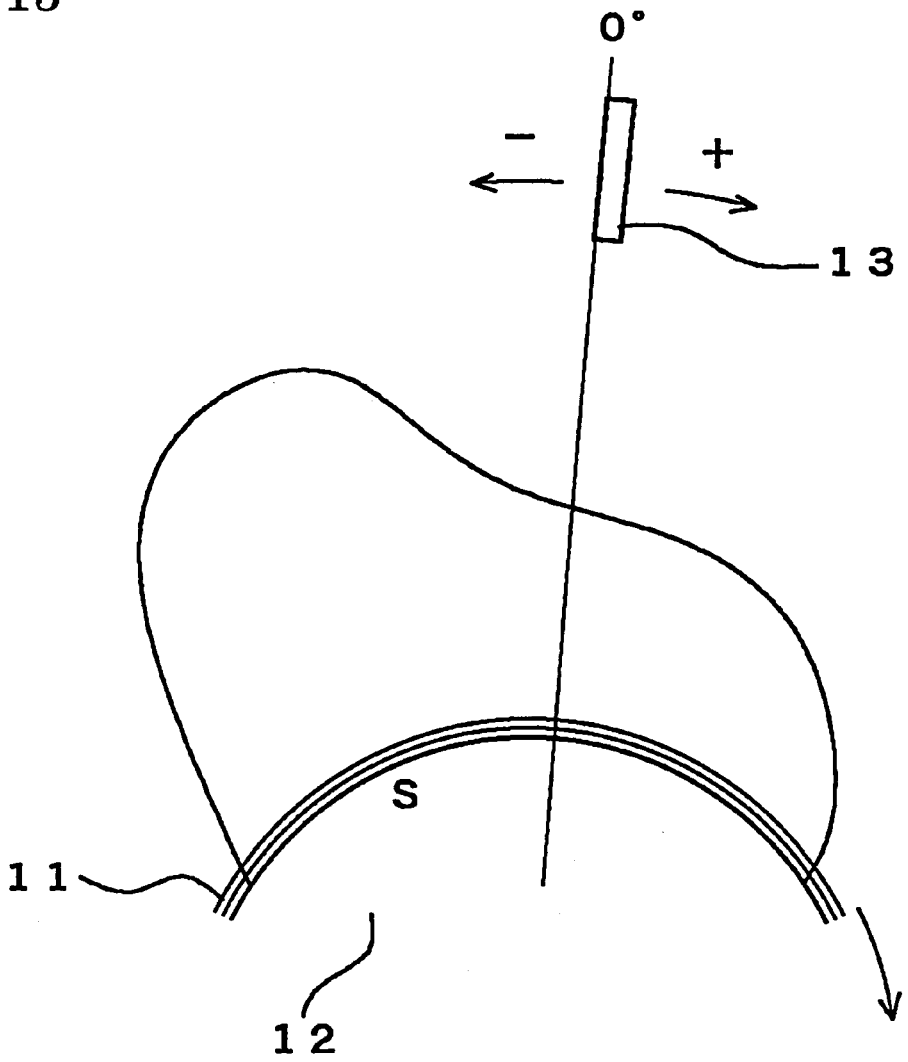
FIG. 13 shows the vertical magnetic force distribution of the magnetic pole of a magnet member at a position opposite the regulating member in the developing device of a third example.

In the developing device of the present example, magnetic pole S of magnet member 12 was changed only in an area confronting regulating member 13 in the developing device of example 1. As shown in FIG. 13, the fluctuation range of vertical magnetic force was narrow, and the vertical magnetic force distribution was flat in an area outside the area of maximum vertical magnetic force of magnetic pole S. In the area having a narrow vertical magnetic force fluctuation range and a flat vertical magnetic force distribution, the vertical magnetic force fluctuation range was about 10 Gauss within an angle of 10° in the circumferential direction.

In this example, the install position of regulating member 13 was moved in the circumferential direction as in example 1. The gap Db between regulating member 13 and developing sleeve 11 was varied, and the change in the amount of developer transported past regulating member 13 was determined.

Figure 14:
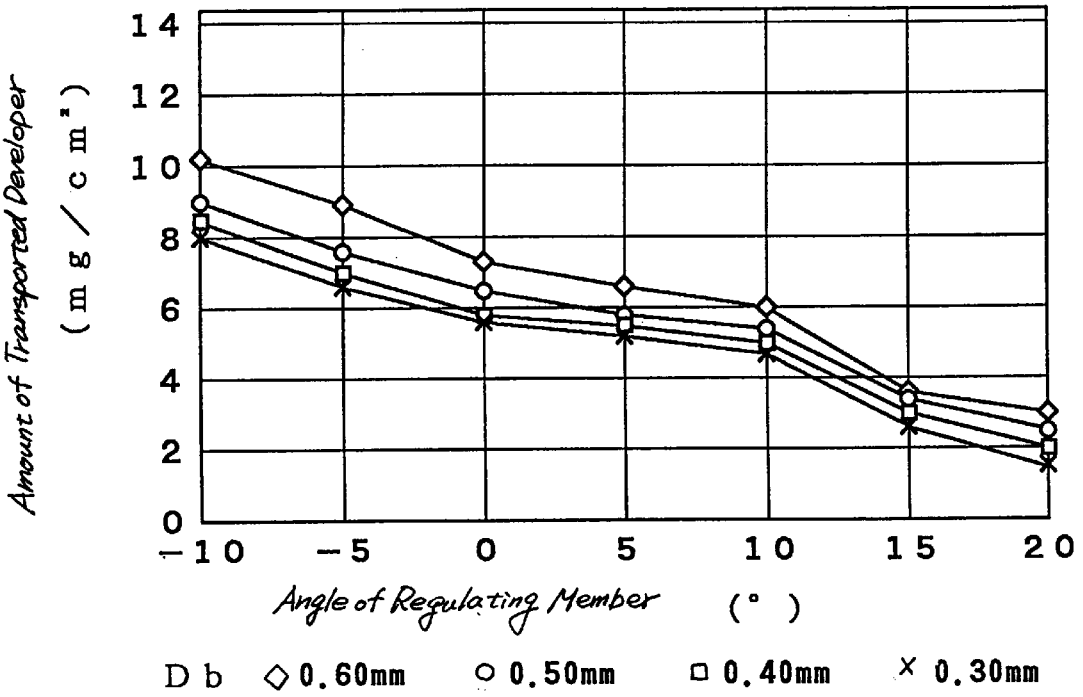
FIG. 14 shows the change in the install angle of the regulating member, and the change in the amount of developer transported past the regulating member in the developing device of the third example.

In this example the regulating member 13 was moved in the circumferential direction. The state wherein the leading edge of regulating member 13 on the upstream side in the developer transport direction was positioned at the area having a flat distribution of vertical magnetic force was designated 0°, and this angle was varied within a range of −10° to +20°; the side wherein the edge of regulating member 13 on the upstream side in the developer transport direction was positioned upstream from the 0 degree position was designated negative, and the downstream side in the developer transport direction was designated positive. The change in the amount of developer transported past regulating member 13 was determined with the gap Db between regulating member 13 and developing sleeve 11 set at 0.60 mm, 0.50 mm, 0.40 mm, and 0.30 mm. Measurement results are shown in FIG. 14. In FIG. 14, a gap Db of 0.60 mm is represented by the ◇ symbol, a gap Db of 0.50 mm is represented by the ○ symbol, a gap Db of 0.40 mm is represented by a □ symbol, and a gap Db of 0.30 mm is represented by the × symbol.

Measurement results in the present example show minimal change in the amount of developer transported past regulating member 13 when the install position of regulating member 13 was varied within a range of 0° to +10° in the area of vertical magnetic force fluctuation of less than 10 Gauss. Furthermore, there was minimal change in the amount of transported developer when the gap Db was varied. Conversely, there was marked variation in the amount of transported developer with even slight dislocation of the install angle of regulating member 13 when regulating member 13 was installed in the area of greatest fluctuation of the vertical magnetic force outside the 0 degree to +10° degree range. The amount of transported developer also varied greatly in conjunction with change in the gap Db.

In the present example, there was minimal change in the amount of transported developer even with slight dislocation in the install position of the regulating member 13 when regulating member 13 was installed within a range of 0° to +10° of the area of vertical magnetic force fluctuation of less than 10 Gauss, such that a suitable amount of developer could be stably delivered to the developing region by developing sleeve 11 to stably produce excellent images of stable density without image noise.

As described above, when the regulating member is disposed at an area such that the fluctuation range of the vertical magnetic force in the magnet member at an area confronting the regulating member is less than 10 Gauss as in the developing device of the present invention, there is only slight fluctuation of the vertical magnetic force of the magnetic pole at a position confronting the regulating member even when there is dislocation of the position of the installed regulating member, or position of the magnet member on the interior side of the developing sleeve within the area of the fluctuation range of less than 10 Gauss.

Therefore, even when there is dislocation of the position of the regulating member and the like, there is only slight variation in the amount of developer regulated by the regulating member and transported to the developing region, and developing is accomplished using a stable amount of developer transported to the developing region so as to produce excellent images having stable density and without image noise.

In the present invention, as clearly understood from the above, an angular range where the area of flat vertical magnetic force distribution is preferably 10° or greater, and more preferably 20° or greater, for easily setting the regulating member in the area of flat vertical magnetic force distribution without an extreme precision with regard to the positional relationship between the magnetic pole developing sleeve and the regulating member.

Although the present invention has been fully described by way of examples with reference to the accompanying drawings, it is to be noted that various changes and modification will be apparent to those skilled in the art.

Therefore, unless such changes and modifications depart from the scope of the present invention, they should be construed as being included therein.

What is claimed is:

1. A developing device having a developing sleeve to transport developer to a developing region opposite an image-carrying member, said developing device comprising:

a developing sleeve provided with a magnet member having a plurality of magnetic poles disposed on the interior side thereof; and a regulating member which regulates the amount of developer transported to a developing region by said developing sleeve;

wherein said regulating member is constructed as a magnetic member, is disposed opposite said developing sleeve through a predetermined gap, and is disposed in an area of flat magnetic force distribution having fluctuation of less than 10 Gauss in vertical magnetic force generated by the magnetic poles.

2. The developing device as claimed in claim 1, wherein said area is extended in an angular range of 10° or greater.

3. The developing device as claimed in claim 2, wherein said area is extended in an angular range of 20° or greater.

4. The developing device as claimed in claim 3, wherein the vertical magnetic force in said area is 300 Gauss or greater.

5. The developing device as claimed in claim 2, wherein the vertical magnetic force in said area is 300 Gauss or greater.

6. The developing device as claimed in claim 1, wherein an alternating current electric field is applied between said developing sleeve and an electrostatic latent image-carrying member.

7. The developing device as claimed in claim 1, wherein said predetermined gap between said regulating member and said developing sleeve is 0.6 mm or less.

8. The developing device as claimed in claim 7, wherein said regulating member regulates the developer so that the amount of developer transported by said developing sleeve to the developing region is 4 $mg/cm^2$ or greater but less than 6.5 $mg/cm^2$.

9. The developing device as claimed in claim 1, wherein said regulating member regulates the developer so that the amount of developer transported by said developing sleeve to the developing region is 4 $mg/cm^2$ or greater but less than 6.5 $mg/cm^2$.

10. A developing device having a developing sleeve to transport developer to a developing region opposite an image-carrying member, said developing device comprising:

a developing sleeve provided with a magnet member having a plurality of magnetic poles disposed on the interior side thereof; and a regulating member which regulates the amount of developer transported to a developing region by said developing sleeve; and an electric power source which applies an alternating current electric field between said developing sleeve and an electrostatic latent image-carrying member;

wherein said regulating member is constructed as a magnetic member, is disposed opposite said developing sleeve through a predetermined gap, and is disposed in an area of flat magnetic force distribution with minimal fluctuation in vertical magnetic force generated by the magnetic poles, and wherein the vertical magnetic force in the area is 300 Gauss or greater.

11. The developing device as claimed in claim 10, wherein said area is extended in an angular range of 10° or greater.

12. The developing device as claimed in claim 11, wherein said area is extended in an angular range of 20° or greater.

13. The developing device as claimed in claim 10, wherein said predetermined gap between said regulating member and said developing sleeve is 0.6 mm or less.

14. The developing device as claimed in claim 13, wherein said regulating member regulates the developer so that the amount of developer transported by said developing sleeve to the developing region is 4 $mg/cm^2$ or greater but less than 6.5 $mg/cm^2$.

15. The developing device as claimed in claim 10, wherein said regulating member regulates the developer so that the amount of developer transported by said developing sleeve to the developing region is 4 $mg/cm^2$ or greater but less than 6.5 $mg/cm^2$.

* * * * *